United States Patent [19]

Miller

[11] Patent Number: 5,057,343

[45] Date of Patent: Oct. 15, 1991

[54] EFFERVESCENT CATIONIC FILM FORMING CORROSION INHIBITOR MATERIAL AND PROCESS

[75] Inventor: James E. Miller, Middletown, R.I.

[73] Assignee: The United State of America as represented by the Secretary of the Navy, Washington, D.C.

[21] Appl. No.: 590,185

[22] Filed: Sep. 28, 1990

[51] Int. Cl.[5] ..... B05D 1/18

[52] U.S. Cl. ..... 427/435; 148/275

[58] Field of Search ..... 427/435; 148/275

[56] References Cited

U.S. PATENT DOCUMENTS 4,004,951 1/1977 Dorsay ..... 427/337

4,098,194 7/1978 Miller et al. ..... 427/344

*Primary Examiner*—Janyce Bell

*Attorney, Agent, or Firm*—Michael J. McGowan; Prithvi C. Lall; Michael F. Oglo

[57] ABSTRACT

A material and process for providing a corrosion inhibitor cationic film on the exterior aluminum surface of a weapon when contained in a submarine launch tube. An effervescent tablet containing a corrosion inhibitor material is disposed within the launch tube with the weapon and, upon flooding of the launch tube with seawater, the effervescent tablet releases the corrosion inhibitor material into the water to form a solution that coats the exposed aluminum surfaces of the weapon with a cation film of the corrosion inhibitor material.

9 Claims, 1 Drawing Sheet

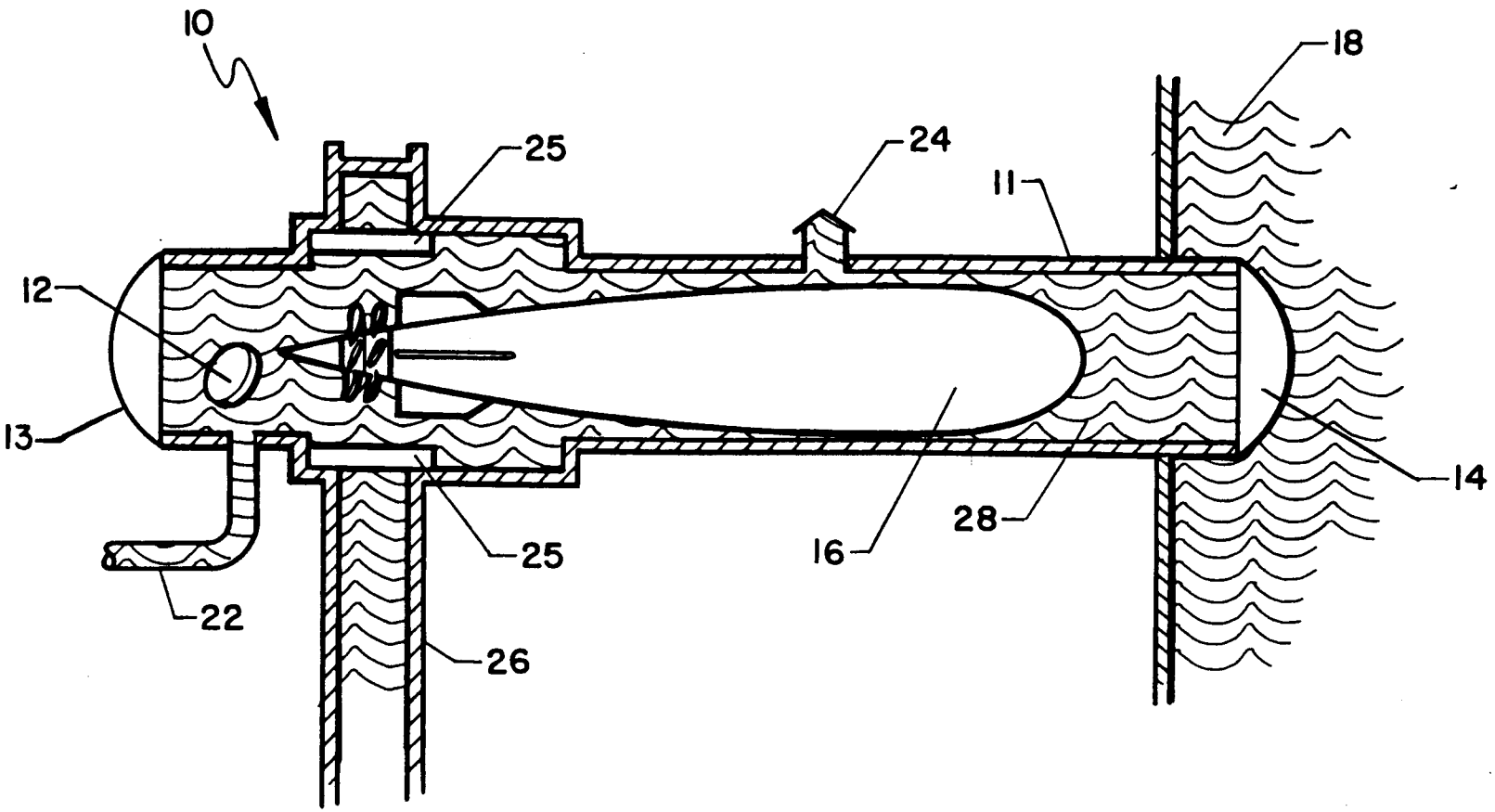
10
12
13
22
25
25
26
24
11
28
16
18
14

EFFERVESCENT CATIONIC FILM FORMING CORROSION INHIBITOR MATERIAL AND PROCESS

STATEMENT OF GOVERNMENT INTEREST

The invention described herein may be manufactured and used by or for the Government of the U.S. of America for governmental purpose without the payment of any royalties thereon or therefor.

BACKGROUND OF THE INVENTION (1) Field of the Invention

This invention relates generally to a material and process for providing a protective corrosion inhibitor coating to an aluminum surface and relates specifically to a material and process for providing a cationic film corrosion inhibitor coating to the exposed aluminum surfaces of submarine weapons positioned in submarine torpedo tubes for launch.

(2) Description of the Prior Art

Since the introduction of high-strength aluminum alloys for construction of submarine weapons, a continuing problem has been seawater induced corrosion. As used herein, "aluminum" is considered to include aluminum and all aluminum alloys. Numerous attempts have been made to eliminate or minimize this corrosion problem but none have proven completely successful. Some of the techniques considered have included providing a paint or special coating on the weapons and/or the torpedo tubes, use of sacrificial anodes attached to the weapons during tube storage, and the use of premixed corrosion inhibitors in the torpedo tube to replace the conventional use of seawater. All of these methods have limitations and valuable weapon assets continue to be lost to the ravages of corrosion. Additionally, the repair of corrosion damage on the weapons is a time consuming and expensive liability.

Paint and coatings on the weapons suffer from the serious disadvantage of having their integrity broken by scratches and abrasions resulting from repeated tube loading and unloading evolutions. These scratches and abrasions, not only expose the bare aluminum but, also create an unfavorably large cathode-to-anode area ratio with the unpainted torpedo tubes which intensifies the corrosion reaction. Limited coating repair can be performed on the submarine or tender but the original integrity can never be fully restored without making extensive repairs to the weapons. At present, touch-up painting of the weapons, combined with routine preventive maintenance, is the primary corrosion prevention method.

Efforts to coat the interior of torpedo tubes with tar-based paints, to minimize the cathode-to-anode area ratio, have also been considered but no fully successful paint has been found that will maintain adhesion over a long period of time. The resulting paint chips damage the torpedo tube slide valve seals and, even when successful, painting of torpedo tubes is a difficult maintenance problem.

The use of sacrificial anodes, such as zinc and magnesium, attached to the weapon, has been shown to result in a significant reduction of corrosion levels. However, the resulting zinc and magnesium hydroxide precipitates cause serious problems in the operation of the torpedo tube slide valves and in the contamination of the submarine trim and drain system, and as a result, preclude this process from being used.

The use of corrosion inhibiting solutions in the weapon tubes instead of seawater has also been considered but never implemented because of the large volume required for the repeated flood down and draining evolutions which occur. Since space is at a premium on all submarines, there is currently no place to store the required large quantities of inhibitor solutions. Also, some trim and drain system modifications could be expected.

SUMMARY OF THE INVENTION

There is thus a definite need in the art for an improved method to eliminate or minimize the seawater induced corrosion of submarine weapons.

Accordingly, it is an object of the present invention to utilize the advantageous corrosion inhibiting features of the prior art systems while minimizing the disadvantages thereof.

Another object of the present invention is to provide a corrosion inhibitor process for submarine weapons therefor that occupies a minimum of space onboard the submarine.

Another object of the present invention is to provide a corrosion inhibiting process that can be used to supplement current procedures now used on submarine weapons.

A further object of the present invention is to provide an improved process for inhibiting corrosion on submarine weapon systems exposed to seawater that imposes no additional maintenance requirements on the submarine crew.

An additional object of the present invention is to provide a material and process for providing a cation film surface coating on the naturally occurring aluminum oxide surfaces of aluminum and aluminum alloy objects.

According to the present invention, the foregoing and additional objects are attained by combining a premeasured amount of water soluble corrosion inhibitor material with an inert effervescent compound to produce an effervescent tablet. That tablet, upon contact with seawater, naturally disperses to produce a water solution of the corrosion inhibitor material in the seawater. The premeasured amount of corrosion inhibitor is based upon the volume of seawater remaining in a submarine tube when it contains a weapon. In practice, the appropriate size, or weight, effervescent tablet is placed in the dry weapon tube along with the weapon prior to a flood down operation. Upon flood down, effervescence of the tablet releases the corrosion inhibitor into solution with the seawater. This solution of corrosion inhibitor forms a protective cation film on any exposed aluminum oxide surfaces on the weapon. Since the inhibitor is fully water soluble, there is no adverse impact on torpedo tube slide valve operation or the trim and drain system of the weapon tube.

BRIEF DESCRIPTION OF THE DRAWING

The sole drawing figure is a part schematic, part sectional view of a typical submarine launch tube and weapon assembly utilizing the present invention.

DETAILED DESCRIPTION OF THE PREFERRED EMBODIMENT

Referring now to the drawing, portions of a typical submarine launch system are schematically shown and designated generally by reference numeral 10. Launch system 10 includes a cylindrical launch tube 11 having a breech door 13 disposed at the aft end and a muzzle door 14 disposed at the forward end. Breech door 13 provides access to launch tube 11 to permit loading of a weapon 16 therein, while muzzle door 14 opens into the sea 18 when weapon 16 is to be launched. In the illustrated embodiment, launch tube 11 has been loaded with weapon 16, and effervescent tablet 12 inserted therein prior to tube flood down with seawater 28.

A combination flood-and-drain and blow-and-vent system act together to flood and drain launch tube 11 and to equalize tube pressure with sea pressure. This system (not shown) is in fluid communication with launch tube 11 through tubing 22. During flood down, vent tube 24 in launch tube 11 is opened to permit escape of any entrapped air therein and slide valve 25 is maintained in the closed position shown. Slide valve 25 serves to open the interior area of launch tube 11 to tubing 26 leading to a pressure actuated ram ejection mechanism (not shown). When it is desired to launch weapon 16, slide valve 25 opens launch tube 11 to tubing 26 and ram ejection pressure, acting through tubing 26, forces weapon 16 through the opened muzzle door 14 toward its target.

When weapon 16 is not launched, as in training exercises or in the event the target is no longer in range or available, it is removed from the launch tube and returned to weapons stowage. Removal of weapon 16 requires that launch tube 11 be drained of the flooded seawater 28 through tubing 22, as described hereinbefore.

The frequent exposure of weapon 16 to seawater causes corrosion. Effervescent tablet 12 serves to provide a protective cation film surface on the naturally occurring aluminum oxide surfaces of these aluminum and/or aluminum alloy materials to prevent or inhibit the corrosion action. The inhibiting action results from the elimination of oxygen reduction reactions as described by Arnott, Hinton, and Ryan, Corrosion, Vol. 45, No. 1, pp. 12–18.

In a specific example of the preferred embodiment, the corrosion inhibitor is nickel chloride ($NiCl_2$), with sodium bicarbonate ($NaHCO_3$) and citric acid providing the effervescent action. The volume of a conventional submarine torpedo tube 11, when empty, is approximately 54 $ft^3$ and the volume of the typical weapon 16 positioned in the torpedo tube is approximately 45 $ft^3$, leaving a volume of approximately 9 $ft^3$ occupied by seawater 28 upon flood down of the loaded tube. The flood-and-drain, and the blow-and-vent systems (not shown) act together through tubing 22 to flood and drain the weapon tubes and to equalize the tube pressure with sea pressure when tube 11 contains a weapon 16.

The weight of 9 $ft^3$ of seawater is approximately 261.4 Kg and the desired concentration of the corrosion inhibitor nickel chloride is 1000 ppm. Since 1 ppm equals 0.2614 grams, for 1000 ppm a weight of 261.4 grams of nickel chloride is desired. Thus, to allow for possible weapon volume variations, 300 grams of nickel chloride is employed in each of the corrosion inhibitor tablets 12 of the present invention. A quantity of 300 grams of nickel chloride, 200 grams of sodium bicarbonate and 100 grams of citric acid is contained within each tablet formed to give a ratio of 3:2:1 for the active ingredients. Large quantities containing this ratio of materials are mixed together and pressed into multiple individual tablets, in a conventional manner. When desired, a conventional inert and water soluble binder component may also be added to the mixture to facilitate tablet formation. One or more tablets 12, each having a total weight of 600 grams or 1.3 pounds, may then be easily inserted through breech door 13 into the submarine weapon tube 11 when weapon 16 is loaded therein. Tablets containing 300 grams of the corrosion inhibitor will completely disperse in the 9 $ft^3$ of seawater, normally provided during flood down of the loaded tube (and maintained therein while the tube is loaded), to result in a concentration of at least 1000 ppm nickel chloride in seawater 28 contained within the loaded tube. This concentration of corrosion inhibitor material is adequate to chemically effect a cation film coating of the corrosion inhibitor material on any exposed aluminum or aluminum oxide surface on weapon 16. Where more or less concentrations of the corrosion inhibitor material is desired, multiple or fractional tablets may be placed within the weapon tube.

Other corrosion inhibitor materials operable in the present invention include praseodymium chloride, neodymium chloride, and cerium chloride. Other effervescent materials that may be used with each of the corrosion inhibitor materials include calcium bicarbonate.

Although the invention has been described relative to specific embodiments it is not so limited and there are numerous variations and modifications thereof that will be readily apparent to those skilled in the art in the light of the above teachings.

Thus, it will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A method of providing a protective corrosion inhibitor film coating on the exterior surface of an aluminum weapon comprising:

loading an aluminum weapon into a launch tube;

providing an effervescent material containing preselected a quantity of a water soluble corrosion inhibitor;

placing the effervescent material within said launch tube; and filling said launch tube with water to cause the effervescent material to undergo effervescence and produce a corrosion inhibitor solution that contacts the exterior surface of said aluminum weapon thereby producing a protective cation film of said corrosion inhibitor material on the exposed aluminum weapon surfaces contacted thereby.

2. The method of claim 1 wherein the water soluble corrosion inhibitor is selected from the group of corrosion inhibitor materials consisting of: nickel chloride, praseodymium chloride, neodymium chloride and cerium chloride.

3. The method of claim 1 wherein the effervescent material is in the form of a tablet, said tablet containing a quantity of nickel chloride and a quantity of inert effervescent material, said effervescent material consisting of a quantity of sodium bicarbonate and a quantity of citric acid.

4. The method of claim 1 wherein the aluminum weapon is in a submarine weapon tube and the effervescent material is a tablet placed within the tube when a weapon is loaded therein and the step of filling the launch tube with water comprises flooding the weapon loaded weapon tube with seawater.

5. The method of claim 1 wherein the launch tube is a weapon launch tube on a submarine and including the step of loading an aluminum surfaced weapon within the launch tube when placing the effervescent material therein and wherein the step of filling the launch tube with water comprises flooding the launch tube with seawater and the corrosion inhibitor solution resulting therefrom also produces a protective cation film of the corrosive inhibitor material on the aluminum surfaced weapon.

6. The method of claim 5 wherein the water soluble corrosion inhibitor is selected from the group of corrosion inhibitor materials consisting of nickel chloride, praseodymium chloride, neodymium chloride and cerium chloride.

7. A method of simultaneously coating the exposed aluminum surface of a weapon in a launch tube on a submarine with a corrosion inhibitor film, comprising:

providing an effervescent tablet containing a quantity of a water soluble inhibitor material;

inserting the effervescent tablet within the weapon launch tube when the weapon is loaded into the tube; and flooding the tube with seawater to cause the effervescent tablet to disperse and form a solution of the corrosion inhibitor material that coats the exterior surface of the weapon with a protective cation film of the corrosion inhibitor material.

8. The method of claim 7 wherein the corrosion inhibitor material is selected from the, group of corrosion inhibitor materials consisting of nickel chloride, praseodymium chloride, neodymium chloride and cerium chloride.

9. The method of claim 7 wherein the effervescent tablet delivers a concentration of corrosion inhibitor material of approximately 1000 ppm in the volume of seawater that floods the weapon tube.

* * * * *